340-566 SR
10/1/85 XR 4,544,920

United States Patent [19]

Hamlin

[11] Patent Number: 4,544,920

[45] Date of Patent: Oct. 1, 1985

[54] INTRUSION DETECTOR AND METHOD

[76] Inventor: Jerry J. Hamlin, 2356 N. 64th St., Mesa, Ariz. 85205

[21] Appl. No.: 437,156

[22] Filed: Oct. 27, 1982

[51] Int. Cl.[4] ..... G08B 13/00; G08B 15/00

[52] U.S. Cl. ..... 340/565; 340/328; 340/566

[58] Field of Search ..... 340/565, 566, 328, 329

[56] References Cited

U.S. PATENT DOCUMENTS

| | | | |
|---|---|---|---|
| 3,761,912 | 9/1973 | Stettner et al. | 340/566 |
| 4,212,007 | 7/1980 | Reyes et al. | 340/545 |
| 4,344,071 | 8/1982 | Allen | 340/566 |
| 4,408,308 | 10/1983 | Smith et al. | 340/565 |

*Primary Examiner*—Howard A. Birmiel
*Attorney, Agent, or Firm*—Weiss & Holloway

[57] ABSTRACT

Apparatus and method are provided for protecting an unoccupied building. The apparatus includes a noise detector for detecting noises generated by attempts to enter the building. Any noise detected is converted to an electronic signal and conveyed to an activator. The activator turns on a tape player which plays a tape recording of noise such as a barking dog. The noise is played through speakers within the building to give the impression the building is occupied or guarded by a watchdog.

4 Claims, 3 Drawing Figures

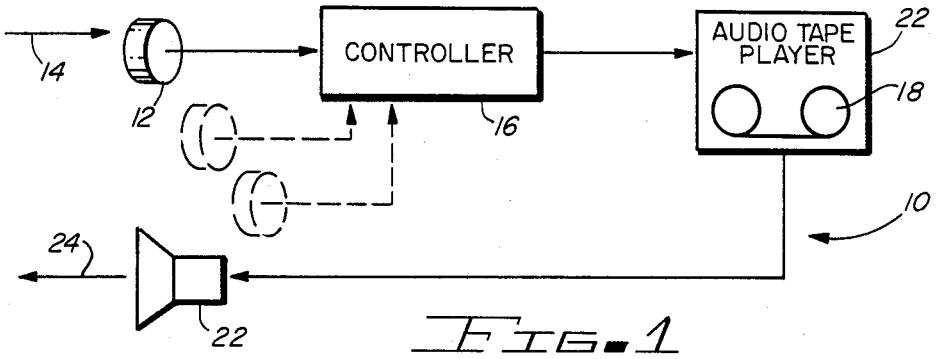
FIG. 1
FIG. 2
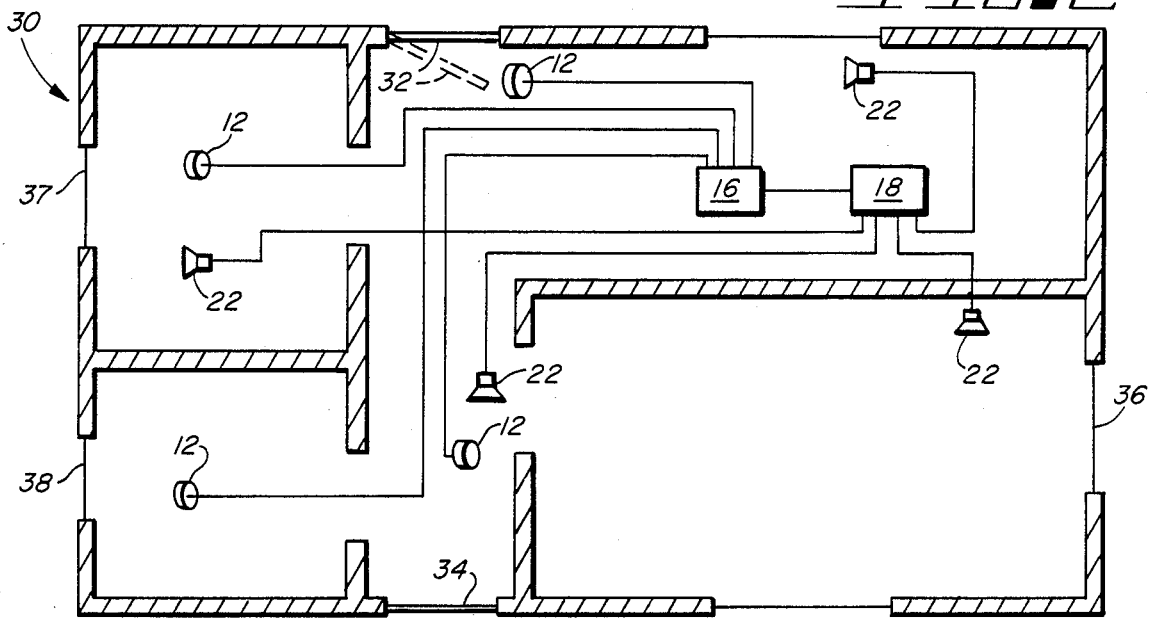
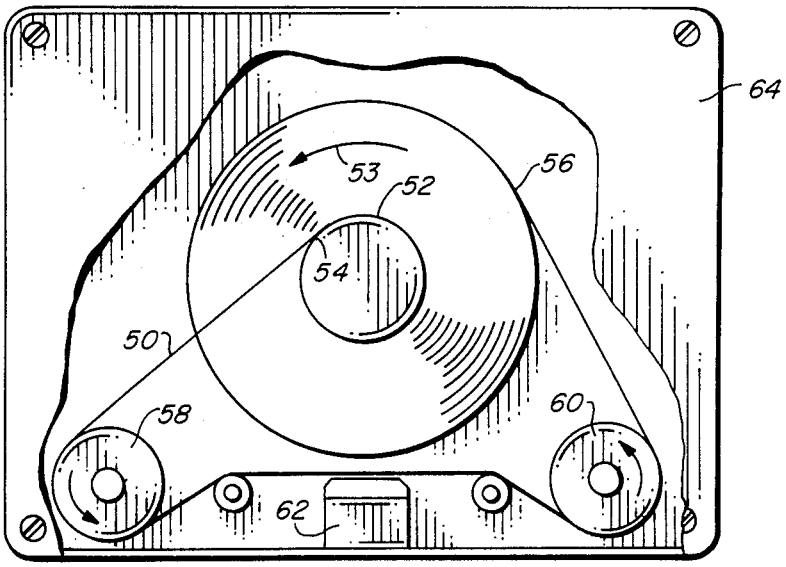
FIG. 3

INTRUSION DETECTOR AND METHOD

BACKGROUND OF THE INVENTION

This invention relates, in general, to a method and apparatus for protecting a building and, more specifically, to a method and apparatus for preventing intrusion into an unoccupied building.

There is a growing need for protecting buildings against unwanted and unauthorized entry. While dead bolt locks, window locks and the like make it more difficult to break into a building, there is a strong belief that, given enough time, a burglar can enter even the most securely locked building. There is, therefore, a need to provide additional security for buildings, especially for unoccupied buildings. To this end, there are a number of burglar alarm systems which attempt to deter or intercept burglars or other unauthorized entrants. Such alarms make a loud noise outside the building to attract attention or set off a warning in a nearby home, police station, or the like. One such alarm, for example, is the Deter-Mike Model manufactured by Astro-Guard Ind., Inc. of San Marcos, Calif. This alarm detects a person entering or within the building and sounds an outside alarm. These alarms, however, have a number of disadvantages and disabilities. If inspection indicates there is no one nearby to respond to an outside alarm, a burglar may not be deterred by the loud sounds. Also, dogs, neighborhood children, mail carriers, newspaper delivery boys, and the like, may cause an alarm to be set off in a "false alarm" situation. False alarms are a nuisance and, in the long term, subvert the efficiency of the system.

Accordingly, a need existed for an alarm which would provide security against unwanted entry without the attendant problems of false alarms.

It is therefore an object of this invention to provide an improved entry deterrant system.

It is a further object of this invention to provide an improved method for securing a building against unwanted entry.

It is a still further object of this invention to provide an improved system for deterring possible burglars without false alarms.

BRIEF SUMMARY OF THE INVENTION

The foregoing and other objects and advantages of the invention are achieved through use of a system which produces noise within a building to deter possible burglars. The system includes one or more noise detectors for detecting sounds associated with actual or potential unauthorized building entry. Any noise detected activates a tape player which plays a tape recording of a barking dog or other building occupancy sounds. The recording is played through speakers located inside the building so that the sound is heard by the actual or potential entrant without disturbing neighbors or the like.

BRIEF DESCRIPTION OF THE DRAWINGS

FIG. 1 is a block diagram illustrating a deterrant system in accordance with the invention;

FIG. 2 illustrates the application of the invention in a building; and

FIG. 3 illustrates a continuous audio tape recording.

DETAILED DESCRIPTION OF THE PREFERRED EMBODIMENTS

FIG. 1 schematically illustrates, in block diagram form, a deterrant system 10 in accordance with the invention. The system includes one or more sound detectors 12 for detecting any sound 14 which is made by a possible building entrant. The sounds to be detected include the sound made in attempting to force open a door or window, ringing of the doorbell, ringing of the telephone, and the like. The sound detector can be a microphone or the like. A single sound detector can be positioned, for example centrally, in the building, or preferably, a plurality of detectors can be positioned around the interior of the building. The plurality of detectors can be positioned, for example, near several of the potential building entrances.

Sound detected by any of the detectors is converted to a electrical signal and this signal is conveyed to a controller 16. In a preferred embodiment, the sound detector is a microphone and the microphone converts the detected noise to an electrical signal. The signal is conveyed to the controller by wires, using the building wiring, by broadcasting, for example, FM broadcasting, or the like. The controller includes electronic circuitry of the type well known to those skilled in the art for activating electronic equipment, here an audio tape player 18 in response to an electrical signal. The tape player is provided with an audio tape recording 20 of sounds indicating the building is occupied. Preferably the tape recording includes the sound of a large dog barking or snarling to give the impression the building is guarded by a watch dog. The tape recorded sounds are played by the tape player through one or more speakers 22 located in the building. The speakers broadcast the sound 24 of the barking dog or the like. Preferably a plurality of speakers are positioned about the interior of the building and controller 16 causes the sound to be broadcast by the particular speaker located near the position at which the entry noise was detected.

FIG. 2 illustrates the application of a system in accordance with the invention to the protection of a building 30 against unauthorized entrance. Building 30 can be entered, for example, through doors 32, 34 or through windows 36, 37, 38. Buildings may have many intended and unintended entrances, but building 30, with the doors and windows shown, serves to illustrate the essential features of the invention.

In a preferred embodiment, a plurality of microphones 12 are positioned about the interior of building 30 and especially near the entrances to detect sounds of possible unauthorized entry attempts as well as sounds made by a potential entrant to determine whether or not entry is warranted at that time. The latter include ringing a doorbell or telephoning to see if someone is in the building. Possible sounds of unauthorized entry include the noise made in forcing a door or window, breaking a window, or the like.

The sound detected by the sound detector 12 is converted to an electrical signal and that signal is coupled, for example by wires, to a controller 16. A single controller can accomodate a plurality of detectors 12. If a noise is detected by any of the detectors, an electrical signal is coupled to the controller and the controller, in turn, activates an audio tape player 18.

The tape player is provided with a tape recording of, for example, a loud barking dog. In response to a detected noise, the tape player is turned on and the recording of the barking dog is played for a few seconds to give the impression that the building is guarded by a watchdog. The sound of the watchdog is played on broadcast inside the building through speakers 22. Preferably the speakers are located at a number of locations throughout the building. An unauthorized entrant thus, after making some noise, is confronted by the sound of a barking watchdog. If the unauthorized entrant has had an accomplice call on the telephone, the person located outside the building likewise is confronted by the sound of the recording.

In a preferred embodiment the plurality of speakers 22 are keyed by the controller to the plurality of detectors 12 so that if noise is detected by one of the detectors, the recorded sound is played by a speaker near that location. By so keying the detectors and speakers, the attempted entrant is seemingly confronted by a watchdog located near the intended point of entry.

Controller 16 can include an on/off switch for deactivating the system when the building is occupied. The controller can further include delay means for delaying the start of a subsequent activation of the tape player after the tape has played for a predetermined time. The delay prevents the noise detectors from sensing the tape recorded noise and latching into a continuously activated mode.

In accordance with the invention, the recorded sounds are played inside the building to convey the impression the building is occupied or guarded. If the system is activated by noise other than that of an unauthorized entrant, the resultant tape recorded sounds are heard only within or near the building. Neighbors or others rightly in the vicinity are not bothered by a false alarm and the problems attendant with false alarms are effectively removed.

Repeated activation of the intrusion prevention system, either proper activation or false alarms, can cause the tape player to be "on" for a considerable length of time and can, therefore, cause a considerable amount of tape to be played. To avoid reaching the end of the recorded tape and causing the system to become inoperative, a continuous rcording tape can be used. FIG. 3 illustrates a continuous play tape 50 in a cassette format. Tape 50 is wound about a reel 52 which turns in the direction shown by arrow 53. As reel 52 turns, tape 50 unwinds from the center at 54 and rewinds on the outside at 56. As the tape unwinds, it passes over rollers 58 and 60 and past tape head 62. The tape is encased in a cassette 64. Use of the continuous play tape allows the intrusion protection system to operate for long periods of time without operator assistance or tape rewinding.

Thus it is apparent that there has been provided, in accordance with the invention, a system and method for protecting a building from unauthorized entry that fully meet the objects and advantages set forth above. Although the invention has been described and illustrated with reference to specific embodiments thereof, it is not intended that the invention be so limited. Other recorded sounds and other methods for arranging detectors and speakers, for example, are among the variations and modifications that will be apparent to those skilled in the art after review of the foregoing description. Accordingly, it is intended to encompass all such variations and modifications that fall within the spirit and scope of the invention.

What is claimed is:

1. A building intrusion projection system which comprises:

a plurality of means for detecting noise of attempted entry, said means for detecting including a plurality of audio microphones located proximate a plurality of possible building entry sites;

recorded response means including an audio tape player having a continuous play audio tape with a recording of sounds of an excited dog;

speakers located within said building for broadcasting said recorded response means;

means responsive to said means for detecting for activating said recorded response means through at lease one speaker having a pre-established relationship with said means for detection activating said recorded response means, said responsive means including a controller coupled to said audio microphones through building wiring.

2. The system of claim 1 wherein said means responsive further comprises means for turning off said recorded response means after a predetermined time.

3. The system of claim 2 wherein said means responsive further comprises delay means for preventing said recorded response means being turned on again after being turned off.

4. A method for protecting an unoccupied building which comprises the steps of:

placing a plurality of noise detectors within said building to detect noise of attempted entry;

providing a tape player within said building;

providing said tape player with a continuous play tape recording of a sounds of an excited dog;

placing a plurality of speakers within said building for broadcasting said recording played on said tape player;

providing tape player activating means for turning on said tape player in response to noise detected by said noise detector; and activating at least one of said speakers, said at least on speaker determined by an identified noise detector detecting said noise.

* * * * *